US008002581B1

(12) United States Patent
Whiteman, Jr. et al.

(10) Patent No.: US 8,002,581 B1
(45) Date of Patent: Aug. 23, 2011

(54) GROUND INTERFACE FOR A CONNECTOR SYSTEM

(75) Inventors: Robert Neil Whiteman, Jr., Middletown, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/790,042

(22) Filed: May 28, 2010

(51) Int. Cl.
*H01R 13/648* (2006.01)

(52) U.S. Cl. ..... 439/607.18

(58) Field of Classification Search ..... 439/79, 439/607.05, 607.06, 607.07, 607.09, 607.11, 439/607.12, 607.13, 607.17, 607.18
See application file for complete search history.

(56) References Cited

U.S. PATENT DOCUMENTS 4,401,355 A * 8/1983 Young ..... 439/607.11
* cited by examiner

*Primary Examiner* — Javaid Nasri

(57) ABSTRACT

A connector assembly includes contacts with contact tails and mating portions opposite the contact tails. The contact tails are configured to be terminated to a circuit board. The mating portions are configured to be terminated to corresponding mating contacts of a mating connector assembly. The connector assembly also includes a shield body holding the contacts. The shield body has a mounting end configured to be mounted to the circuit board. The mounting portions have web portions extending between selected contacts. The connector assembly includes a conductive gasket positioned along the mounting end of the shield body. The conductive gasket engages the web portions of the shield body and is configured to define a ground path between the shield body and a ground plane of the circuit board.

20 Claims, 9 Drawing Sheets

GROUND INTERFACE FOR A CONNECTOR SYSTEM

BACKGROUND OF THE INVENTION

The subject matter herein relates generally to connector assemblies, and more particularly, to shielded connector assemblies.

Some electrical systems utilize electrical connectors to interconnect two circuit boards, such as a motherboard and daughtercard. The electrical connectors typically include a plurality of signal contacts and a plurality of ground contacts that are held within a common housing of the corresponding electrical connector. The signal and ground contacts have contact tails that extend from the housing and are mounted to the corresponding circuit board, such as by loading the contact tails into plated vias of the circuit board. In typical high speed connectors, the signal contacts are arranged in differential pairs, with ground contacts on one or both sides of the signal contacts of the differential pairs, such as in a ground-signal-signal-ground pattern.

Known electrical systems are not without disadvantages. For instance, the positions of the ground contacts within the electrical connectors and the footprint of ground vias within the circuit board are typically controlled by the manufacturability of the electrical connector. The positions of such ground contacts and ground vias may not be positioned in the most desirable location from an electrical performance standpoint, due to manufacturability. For example, the ground and signal contacts are typically arranged in rows and columns, and therefore, the ground vias and signal vias are also arranged in rows and columns. However, a different footprint of ground vias with respect to the signal vias may be more desirable. For example, having additional ground vias surrounding the signal vias may be more desirable. Furthermore, the diameters of the ground vias are controlled by manufacturability constraints. For example, the size of the contact tails may dictate the size of the ground vias. However, a larger or smaller diameter ground via may be more desirable to control the electrical characteristics of the circuit board. For example, changing the diameter size may affect impedance, cross-talk, or overall footprint layout.

A need remains for an electrical system that provides an efficient ground interface between electrical connectors and circuit boards.

BRIEF DESCRIPTION OF THE INVENTION

In one embodiment, a connector assembly is provided that includes contacts with contact tails and mating portions opposite the contact tails. The contact tails are configured to be terminated to a circuit board. The mating portions are configured to be terminated to corresponding mating contacts of a mating connector assembly. The connector assembly also includes a shield body holding the contacts. The shield body has a mounting end configured to be mounted to the circuit board. The mounting portions have web portions extending between selected contacts. The connector assembly includes a conductive gasket positioned along the mounting end of the shield body. The conductive gasket engages the web portions of the shield body and is configured to define a ground path between the shield body and a ground plane of the circuit board.

In another embodiment, a connector assembly is provided that includes contact modules each having a dielectric body with a mating end and a mounting end. The contact, modules each have a plurality of contacts with contact tails extending from the mounting end of the dielectric body. A shield body holds the contact modules in a stacked configuration. The shield body has a mounting end configured to be mounted to a circuit board. The shield body extends between selected contact modules and is exposed along the mounting end. A conductive gasket is positioned along the mounting end of the shield body. The conductive gasket engages the shield body and is configured to define a ground path between the shield body and a ground plane of the circuit board.

In a further embodiment, a connector system is provided that includes a circuit board having a mounting surface with a plurality a signal vias and a plurality of ground vias. The circuit board has a ground plane along the mounting surface that interconnects the plurality of ground vias. The connector system also includes a connector assembly mounted to the circuit board. The connector assembly includes contacts with contact tails and mating portions opposite the contact tails. The contact tails are configured to be terminated to a circuit board. The mating portions are configured to be terminated to corresponding mating contacts of a mating connector assembly. The connector assembly also includes a shield body holding the contacts. The shield body has a mounting end configured to be mounted to the circuit board. The mounting portions have web portions extending between selected contacts. The connector assembly includes a conductive gasket positioned along the mounting end of the shield body. The conductive gasket engages the web portions of the shield body and is configured to define a ground path between the shield body and a ground plane of the circuit board.

DETAILED DESCRIPTION OF THE INVENTION

Figure 1:
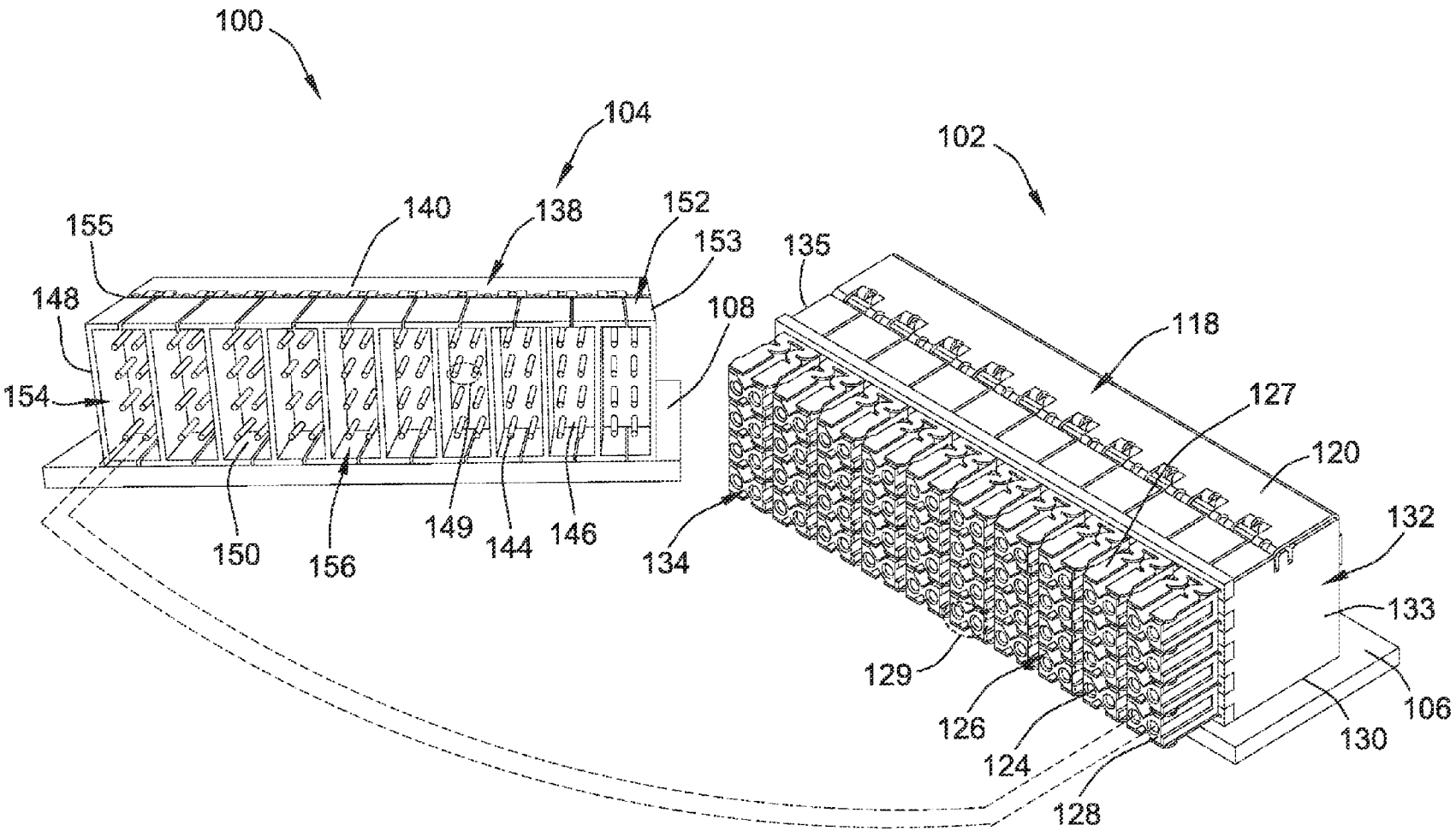
FIG. 1 is a perspective view of a connector system showing a header assembly and receptacle assembly.

FIG. 1 is a perspective view of an exemplary embodiment of a connector system 100 illustrating a receptacle assembly 102 and a header assembly 104 that may be directly mated together. The receptacle assembly 102 and/or the header assembly 104 may be referred to hereinafter individually as, a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented coplanar to one another when the receptacle and header assemblies 102, 104 are mated. Alternative orientations of the circuit boards 106, 108 are possible in alternative embodiments. For example, the circuit boards 106, 108 may be parallel to one another, but non-coplanar with respect to one another. In some alternative embodiments, the circuit boards 106, 108 may be perpendicular to one another.

In an exemplary embodiment, the receptacle assembly 102 is similar to the receptacle assembly described in concurrently filed U.S. patent application Ser. No. 12/790,246, the complete subject matter of which is herein incorporated by reference in its entirety. The receptacle assembly 102 is modular in design and may include any number of components that are coupled together to create the receptacle assembly 102, depending on the particular application. The receptacle assembly 102 includes a shield body 118 providing selective shielding around and within the shield body 118.

Figure 4:
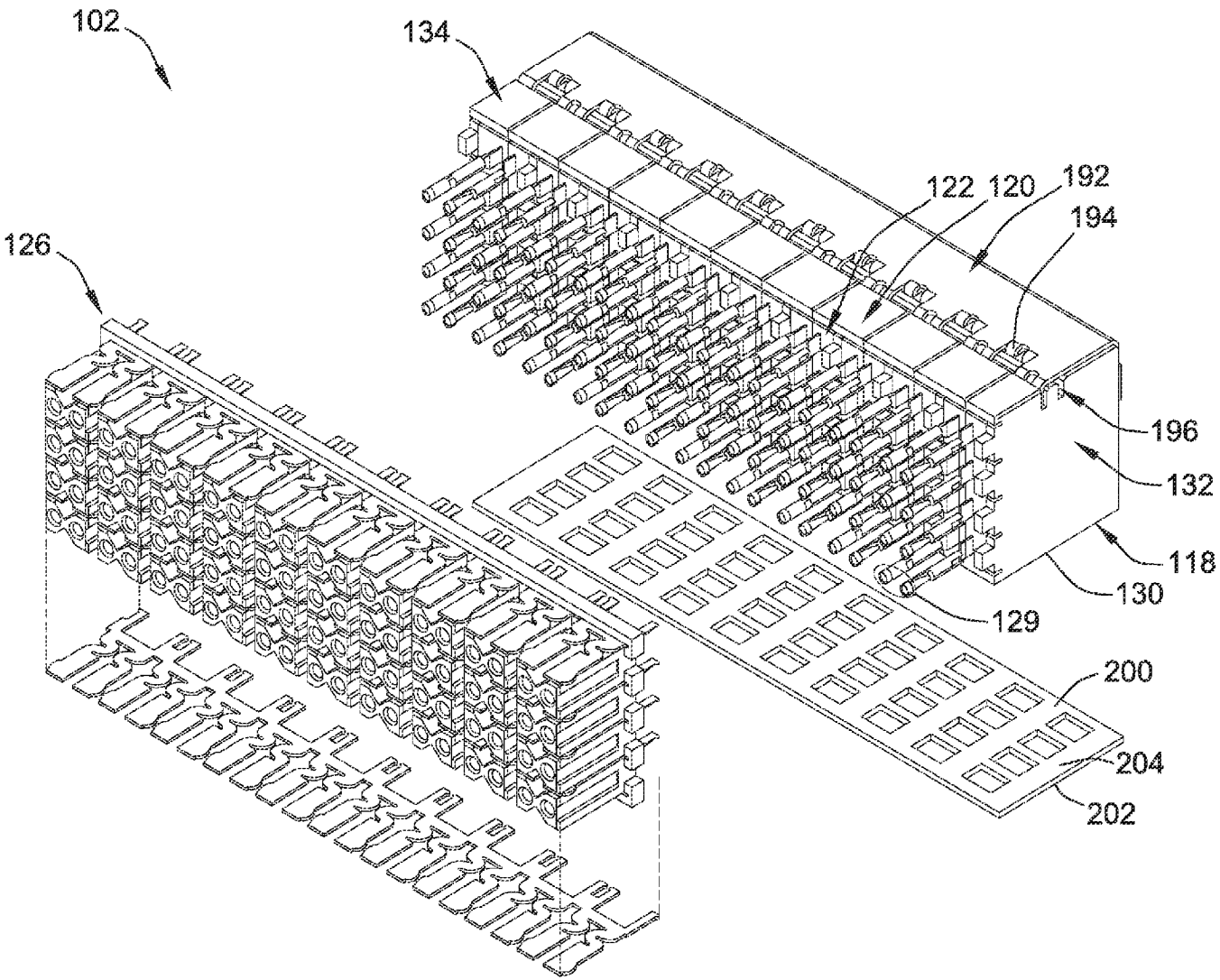
FIG. 4 is an exploded view of the receptacle assembly shown in FIG. 1.

The receptacle assembly 102 includes a plurality of holders 120 that support a plurality of contact modules 122 (shown in FIG. 4). The holders 120 define the shield body 118. The contact modules 122 each include a plurality of receptacle contacts 124. In the illustrated embodiment, the receptacle contacts 124 constitute socket contacts, however other types of contacts may be utilized in alternative embodiments, such as pin contacts, spring beams, tuning-fork type contacts, blade type contacts, and the like. Any number of holders 120 may be provided. The holders 120 facilitate providing the modular design. For example, adding more holders 120 increases the number of contact modules 122 and thus the number of receptacle contacts 124. Alternatively, providing fewer holders 120 reduces the number of contact modules 122, and thus the number of receptacle contacts 124.

The receptacle assembly 102 includes a mating housing 126 at a mating end 128 of the receptacle assembly 102. The receptacle contacts 124 are received in the mating housing 126 and held therein for mating to the header assembly 104. The mating housing 126 provides shielding between selected receptacle contacts 124. For example, the mating housing 126 includes ground clips 127 that provide shielding between rows of receptacle contacts 124. The ground clips 127 are electrically connected to the shield body 118 when the mating housing 126 is coupled to the holders 120.

The receptacle contacts 124 are arranged in a matrix of rows and columns. Any number of receptacle contacts 124 may be provided in the rows and columns. Optionally, the receptacle contacts 124 may be signal contacts arranged as differential pairs 129. The receptacle contacts 124 within each differential pair 129 are arranged within a common row and are part of different contact modules 122 and held in different holders 120. Optionally, the receptacle contacts 124 within each differential pair 129 may have the same length, and thus have a skewless design. Alternatively, the receptacle contacts 124 may be single ended signal contacts as opposed to being differential contacts. In such embodiment, the receptacle assembly 102 may provide shielding between each receptacle contact, as opposed to between the differential pairs 129.

The shield body 118 includes a mounting end 130 that is mounted to the circuit board 106. Optionally, the mounting end 130 may be substantially perpendicular to the mating end 128. The shield body 118 is exposed along the mounting end 130 for electrically grounding to the circuit board 106. A conductive gasket 200 (shown in FIG. 4) is used to create a ground path between the shield body 118 and the circuit board 106. The conductive gasket 200 defines a ground interface between the shield body 118 and the circuit board 106.

The receptacle assembly 102 includes end holders 132, 134 at opposite ends of the receptacle assembly 102. The end holders 132, 134 differ from the intermediate holders 120 provided between the end holders 132, 134, as the end holders 132, 134 only hold a single contact module 122 therein, whereas the holders 120 hold a pair of contact modules 122. Additionally, the end holders 132, 134 have outer surfaces 133, 135 that define outer surfaces of the receptacle assembly 102. The end holders 132, 134 define a portion of the shield body 118.

In an exemplary embodiment, the header assembly 104 is similar to the header assembly described in concurrently filed U.S. patent application Ser. No. 12/790,246, the complete subject matter of which is herein incorporated by reference in its entirety. The header assembly 104 is modular in design and may include any number of components that are coupled together to create the header assembly 104, depending on the particular application. The header assembly 104 includes a shield body 138 providing selective shielding around and within the shield body 138.

Figure 7:
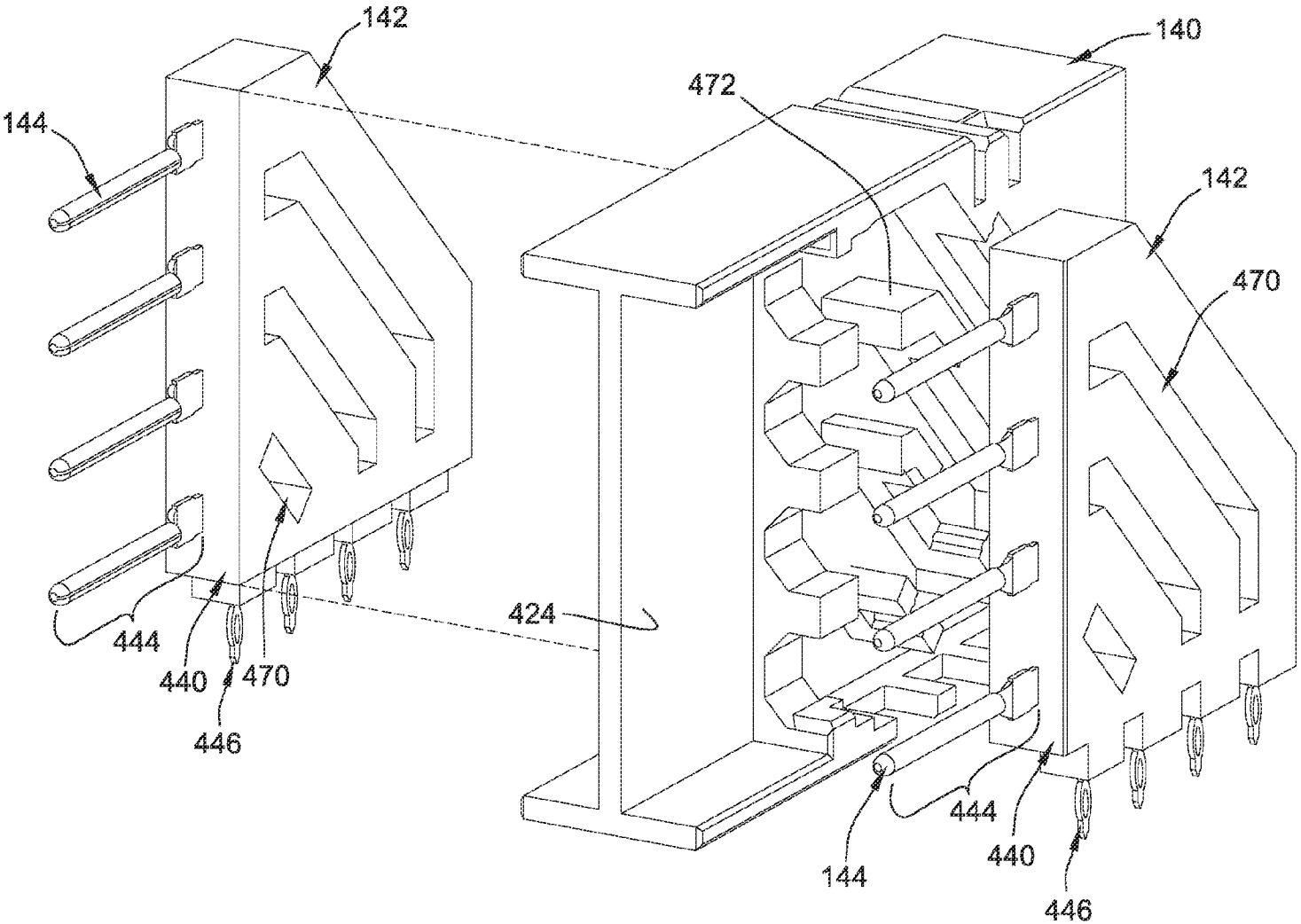
FIG. 7 is a front perspective view of a portion of the header assembly.

The header assembly 104 includes a plurality of holders 140 that support a plurality of contact modules 142 (shown in FIG. 7). The holders 140 define the shield body 138. The contact modules 142 each include a plurality of header contacts 144. In the illustrated embodiment, the header contacts 144 constitute pin contacts, however other types of contacts may be utilized in alternative embodiments, such as socket contacts, spring beams, tuning-fork type contacts, blade type contacts, and the like. Any number of holders 140 may be provided. The holders 140 facilitate providing the modular design. For example, adding more holders 140 increases the number of contact modules 142 and thus the number of header contacts 144. Alternatively, providing fewer holders 140 reduces the number of contact modules 142, and thus the number of header contacts 144.

The header assembly 104 includes a plurality of mating housings 146 at a mating end 148 of the header assembly 104. The header contacts 144 are received in corresponding mating housings 146 and held therein for mating to the receptacle contacts 124 of the receptacle assembly 102. The header contacts 144 are arranged in a matrix of rows and columns that corresponds to the pattern of receptacle contacts 124. Any number of header contacts 144 may be provided in the rows and columns. Optionally, the header contacts 144 may be signal contacts arranged as differential pairs 149. The header contacts 144 within each differential pair 149 are arranged within a common row and are part of different contact modules 142 and held in different holders 140. Optionally, the header contacts 144 within each differential pair 149 may have the same length, and thus have a skewless design.

The shield body 138 includes a mounting end 150 that is mounted to the circuit board 108. Optionally, the mounting end 150 may be substantially perpendicular to the mating end 148. The shield body 138 is arranged along the mounting end 150 for electrically grounding to the circuit board 108. A conductive gasket 400 (shown in FIG. 8) is used to create a ground path between the shield body 138 and the circuit board 108.

In an exemplary embodiment, the header assembly 104 includes end holders 152, 154 at opposite ends of the header assembly 104. The end holders 152, 154 differ from the intermediate holders 140 provided between the end holders 152, 154, as the end holders 152, 154 only hold a single contact module 142 therein, whereas the holders 140 hold a pair of contact modules 142. Additionally, the end holders 152, 154 have outer surfaces 153, 155 that define outer surfaces of the header assembly 104. The end holders 152, 154 define a portion of the shield body 118.

When assembled, the holders 140 and end holders 152, 154 cooperate to define a loading chamber 156 at the mating end 148. The loading chamber 156 is configured to receive a portion of the receptacle assembly 102, such as the mating housing 126. The receptacle assembly 102 is loaded into the loading chamber 156 along a mating axis. The receptacle contacts 124 are mated to the header contacts 144 in the loading chamber 156. In an exemplary embodiment, the connector system 100 may be reversible, wherein the receptacle assembly 102 may be received in the header assembly 104 in two different orientations (e.g. 180° from each other). The size, shape and/or orientation of the mating interfaces are such that the receptacle assembly 102 may be loaded into the loading chamber 156 right side up or upside down.

Figure 2:
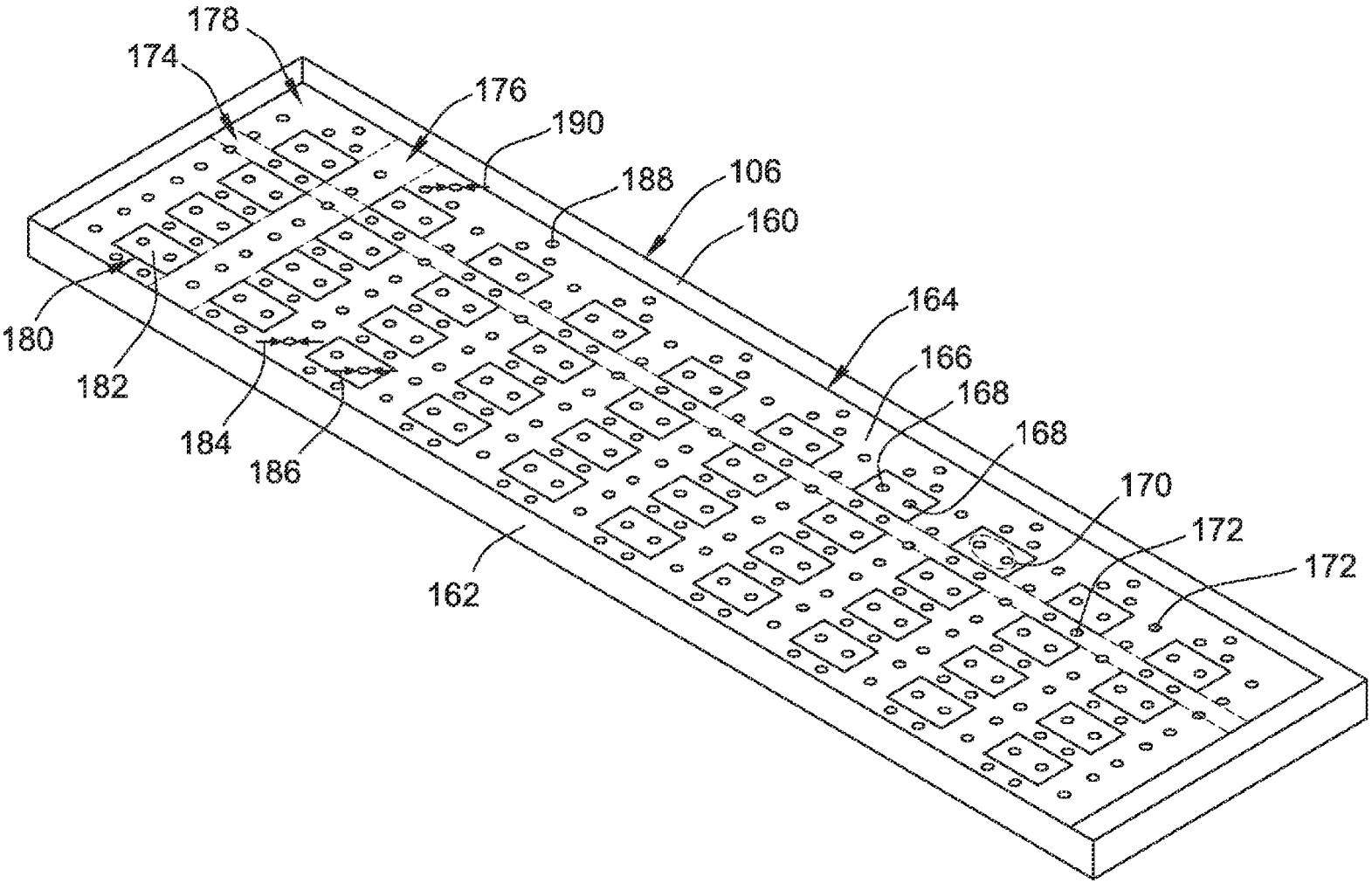
FIG. 2 is a top perspective view of a circuit board for the connector system.

FIG. 2 is a top perspective view of the circuit board 106 for the connector system 100 (shown in FIG. 1). The circuit board 106 includes a mounting surface 160 and a front edge 162. A mounting area 164 is defined along the mounting surface 160 proximate to the front edge 162. The receptacle assembly 102 (shown in FIG. 1) is configured to be mounted to the mounting area 164. The circuit board 106 includes a ground plane 166 on the mounting surface 160. The ground plane 166 is electrically grounded. In an exemplary embodiment, the ground plane 166 is a layer of the circuit board 106 at the mounting surface 160. The ground plane 166 may be a conductive film or coating applied to the mounting surface 160. The ground plane 166 covers, and is exposed along, a majority of the mounting area 164. Alternatively, the ground plane 166 may be defined by a plurality of ground pads on the mounting surface 160 or discrete ground traces on the mounting surface 160. Each of the ground pads may be physically separated from one another at the mounting surface 160, but may be interconnected by other ground planes in the circuit board 106.

The circuit board 106 includes a plurality of signal vias 168 extending at least partially through the circuit board 106. The signal vias 168 are plated vias that are electrically connected to corresponding signal traces routed through the circuit board 106. The signal vias 168 are arranged in a predetermined pattern that corresponds to the pattern of receptacle contacts 124 (shown in FIG. 1). In an exemplary embodiment, the signal vias 168 are arranged in differential pairs 170. The ground plane 166 separates the differential pairs 170 from one another. The signal vias 168 are arranged in a matrix of rows and columns. The signal vias 168 within each column correspond to receptacle contacts 124 within a single contact module 122 (shown in FIG. 4). The rows of signal vias 168 extend generally parallel to the front edge 162. The columns of signal vias 168 extend generally perpendicular to the front edge 162.

The circuit board 106 includes a plurality of ground vias 172 extending at least partially though the circuit board 106. The ground vias 172 are plated vias that are electrically connected to the ground plane 166, and thus electrically grounded. The ground vias 172 may connect to other ground layers within the circuit board 106 as well. The ground vias 172 are arranged in a matrix of rows and columns. The rows of ground vias 172 are arranged parallel to the front edge 162. The columns of ground vias 172 are arranged perpendicular to the front edge 162. The matrix of signal vias 168 and the matrix of ground vias 172 together define a footprint for the receptacle assembly 102. The footprint is bounded by the ground plane 166.

The ground plane 166 includes a plurality of longitudinal strips 174 and plurality of lateral strips 176 that intersect with the longitudinal strips 174 to form a lattice 178. The footprint of signal vias 168 and ground vias 172 is bounded by the outermost longitudinal strips 174 and the outermost lateral strips 176. In an exemplary embodiment, the longitudinal strips 174 and lateral strips 176 are integrally formed with one another. The ground plane 166 includes a plurality of openings 180 between each of the longitudinal strips 174 and each of the lateral strips 176. A dielectric portion 182 of the circuit board 106 is exposed within each opening 180. The signal vias 168 are positioned within the openings 180. The longitudinal strips 174 and lateral strips 176 are electrically isolated from the signal vias 168 by the dielectric portion 182. In an exemplary embodiment, two signal vias 168 are provided within each opening 180. The two signal vias 168 within each opening 180 form a corresponding differential pair 170. The ground vias 172 are aligned with, and electrically connected to, the lattice 178. For example, the ground vias 172 may be aligned with, and electrically connected to, both the longitudinal strips 174 and lateral strips 176. The ground vias 172 are positioned around the openings 180. In an alternative embodiment, rather than longitudinal and lateral strips 174, 176, individual ground pads may be provided at the tops of each of the ground vias 172, for connection to the conductive gasket 200 (shown in FIG. 4)

The layout of the ground vias 172 may be selected to control the electrical characteristics of the connector system 100 within the circuit board 106. For example, the positioning of the ground vias 172 may be selected to control the impedance of the circuit board 106. The positioning of the ground vias 172 may be selected to control cross-talk between signal vias 168 of adjacent differential pairs 170. The positioning of the ground vias 172 may be selected to control other electrical characteristics of the circuit board 106. In an exemplary embodiment, multiple ground vias 172 may be provided between each adjacent differential pair 170 of signal vias 168. Optionally, the ground vias 172 may be aligned with the signal vias 168. Alternatively, the ground vias 172 may be offset with respect to the signal vias 168. Any number of ground vias 172 may be provided within the circuit board 106.

In an exemplary embodiment, the ground vias 172 do not receive ground contacts from the receptacle assembly 102. In contrast, the ground vias 172 are electrically connected to the longitudinal strips 174 and lateral strips 176 of the ground plane. 166. The conductive gasket 200 is configured to be positioned between the mounting surface 160 and the receptacle assembly 102 such that the conductive gasket 200 defines a ground path between the shield body 118 (shown in FIG. 1) and the ground plane 166 of the circuit board 106. The conductive gasket 200 is configured to extend along, and engage, each of the longitudinal strips 174 and the lateral strips 176. As such, the conductive gasket 200 traverses over and covers each of the ground vias 172. No portion of the conductive gasket 200 is designed to be received within the conductive vias 172. Rather, the conductive gasket 200 is electrically connected to the ground vias 172 by the ground plane 166.

The positioning of the ground vias 172 illustrated in FIG. 2 is merely illustrative of an exemplary embodiment of the circuit board 106. Different footprints are possible in alternative embodiments, such as by having a different number of ground vias 172. Additionally, more or less ground vias 172 may be provided to surround each of the openings 180. Because the ground vias 172 are not configured to receive pins or tails of contacts, the ground vias 172 may be sized, shaped and positioned to enhance electrical performance and characteristics of the circuit board 106. For example, the ground vias 172 may have a diameter 184 that is smaller than a diameter 186 of the signal vias 168, because the ground vias 172 do not receive pins or tails of contacts, whereas the signal vias 168 are configured to receive contact tails 242 (shown in FIG. 6) of the receptacle assembly 102. Having smaller diameter ground vias 172 may raise the impedance of the circuit board 106 to a certain amount, such as 100 Ohmes. Additionally, having smaller diameter ground vias 172 allows for the positioning of more ground vias 172 within the circuit board 106.

The circuit board 106 includes a plurality of retainer vias 188 extending through the circuit board 106. The retainer vias 188 are electrically connected to the ground plane 166. In the illustrated embodiment, the retainer vias 188 are aligned with one another in a single row. Optionally, the retainer vias 188 may have a diameter 190 that is larger than the diameter 184 of the ground vias 172 and the diameters 186 of the signal vias 168.

Figure 3:
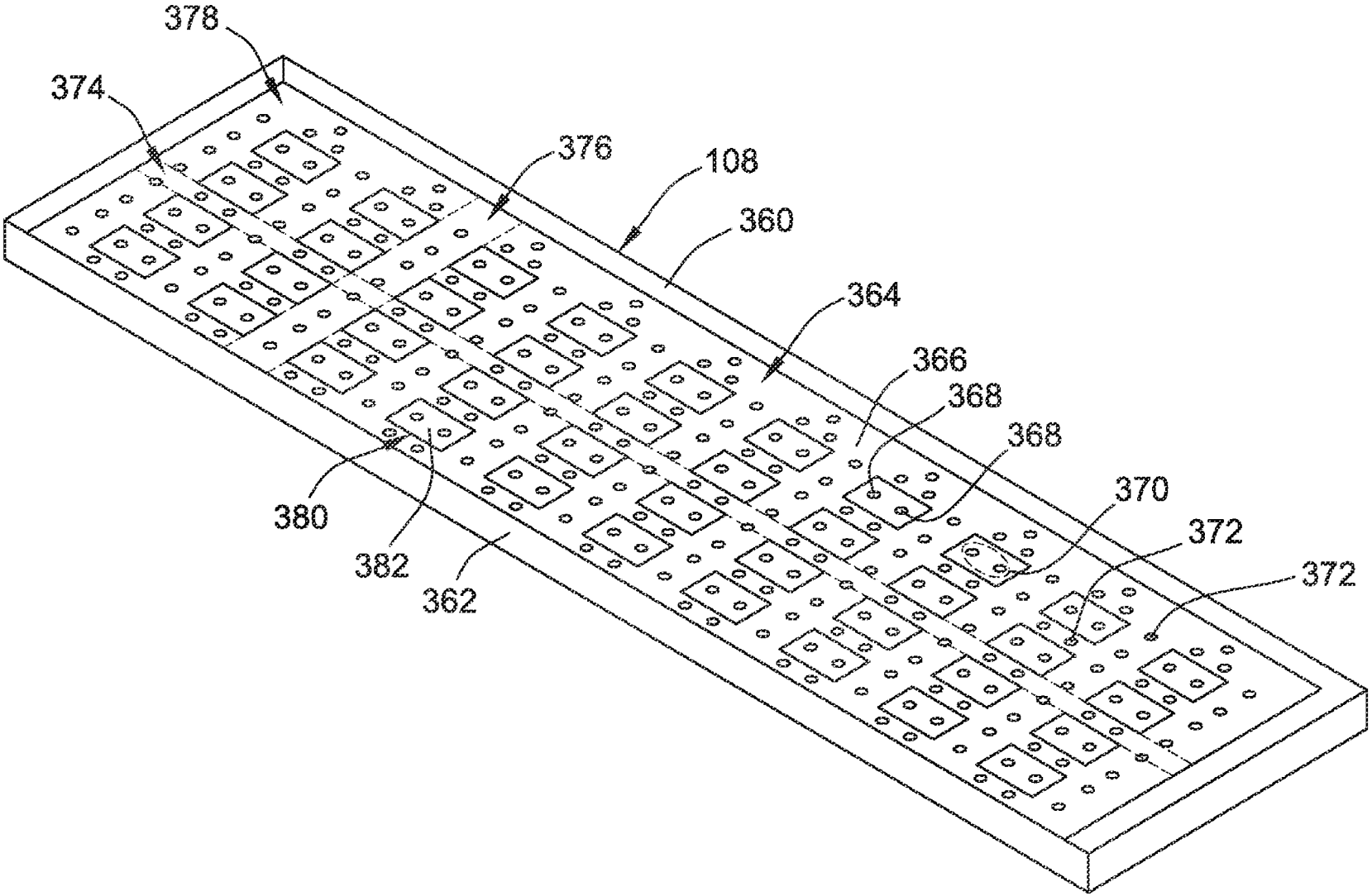
FIG. 3 is a top perspective view of another circuit board for the connector system.

FIG. 3 is a top perspective view of the circuit board 108 for the connector system 100 (shown in FIG. 1). The circuit board 108 includes a mounting surface 360 and a front edge 362. A mounting area 364 is defined along the mounting surface 360 proximate to the front edge 362. The header assembly 104 (shown in FIG. 1) is configured to be mounted to the mounting area 364. The circuit board 108 includes a ground plane 366 on the mounting surface 360. The ground plane 366 is electrically grounded.

The circuit board 108 includes a plurality of signal vias 368 extending at least partially through the circuit board 108. In an exemplary embodiment, the signal vias 368 are arranged in differential pairs 370. The ground plane 366 separates the differential pairs 370 from one another. The circuit board 108 includes a plurality of ground vias 372 extending at least partially though the circuit board 108.

The ground plane 366 includes a plurality of longitudinal strips 374 and plurality of lateral strips 376 that intersect with the longitudinal strips 374 to form a lattice 378. The footprint of signal vias 368 and ground vias 372 is bounded by the outermost longitudinal strips 374 and the outermost lateral strips 376. In an exemplary embodiment, the longitudinal strips 374 and lateral strips 376 are integrally formed with one another. The ground plane 366 includes a plurality of openings 380 between each of the longitudinal strips 374 and each of the lateral strips 376. A dielectric portion 382 of the circuit board 108 is exposed within each opening 380. The signal vias 368 are positioned within the openings 380. The longitudinal strips 374 and lateral strips 376 are electrically isolated from the signal vias 368 by the dielectric portion 382. In an exemplary embodiment, two signal vias 368 are provided within each opening 380. The two signal vias 368 within each opening 380 form a corresponding differential pair 370. The ground vias 372 are positioned around the openings 380.

FIG. 4 is an exploded view of the receptacle assembly 102. FIG. 4 illustrates the contact modules 122 loaded into corresponding holders 120. The mating housing 126 is poised for mounting to the holders 120. FIG. 4 also illustrates the conductive gasket 200 poised for attachment to the mounting end 130 of the receptacle assembly 102.

The conductive gasket 200 defines a ground path between the shield body 118 of the receptacle assembly 102 and the circuit board 106 (shown in FIG. 1). For example, the conductive gasket 200 may engage, and be electrically connected to, the holders 120 to electrically common the holders 120 to a ground circuit on the circuit board 106.

The receptacle assembly 102 includes a retainer 192 coupled to each of the holders 120 and end holders 132, 134. The retainer 192 secures together each of the holders 120 and end holders 132, 134. The retainer 192 includes a plurality of fingers 194 that extend into slots 196 in the holders 120 and end holders 132, 134 to secure the holders 120 and end holders 132, 134. Optionally, the holders 120 and end holders 132, 134 may be coupled directly to one another, such as using alignment or securing features integrated into the holders 120 and end holders 132, 134. Once held together, the holders 120 and end holders 132, 134 form the shield body 118 which structurally supports the contact modules 122 and electrically shields the contact modules 122. The retainer 192 includes a plurality of retainer pins 198 (shown in FIG. 5) that are configured to be received in the retainer vias 188 (shown in FIG. 2) of the circuit board 106. As such, the retainer pins 198 are electrically connected to a ground circuit of the circuit board 106. The retainer 192 is thus grounded and electrically commoned with the circuit board 106. Alternatively, the retainer 192 may be connected to the circuit board 106 via the conductive gasket 200. The reception of the retainer pins 192 in the circuit board 106 helps hold the receptacle assembly 102 onto the circuit board 106. Any number of retainer pins 198 may be provided depending on the particular embodiment.

The conductive gasket 200 includes a first mounting surface 202 that is configured to be mounted to, and engage, the ground plane 166 (shown in FIG. 2) of the circuit board 106. The conductive gasket 200 includes a second mounting surface 204 opposite the first mounting surface 202 that engages the shield body 118. The conductive gasket 200 defines a ground path between the ground plane 166 of the circuit board 106 and the shield body 118 of the receptacle assembly 102. As such, the shield body 118 is electrically grounded through the conductive gasket 200. The conductive gasket 200 allows the receptacle assembly 102 to be electrically grounded to the circuit board 106 without using individual ground contacts or ground pins that are received in the ground vias 172 (shown in FIG. 2) of the circuit board 106. As such, the total number of pins that are terminated to the circuit board 106 is reduced by limiting the pins to signal contacts as opposed to signal and ground contacts. Additionally, positioning of ground vias 172 in the circuit board 106 may be strategically placed as the ground vias 172 do not need to be positioned for mating with corresponding ground pins extending from the receptacle assembly 102 (e.g. because the receptacle assembly 102 does not include ground pins).

The conductive gasket 200 includes an elastomeric sheet that, is compressible to define a compressible interface between the circuit board 106 and the shield body 118. The elastomeric sheet is conductive to define a conductive pathway between the first and second mounting surfaces 202, 204. For example, the conductive gasket 200 may be fabricated from a compliant plastic or rubber material having conductive filler, a conductive plating, a conductive coating and the like. Alternatively, the conductive gasket 200 may be fabricated from a conductive fabric, such as a woven mesh. In other alternative embodiments, the conductive gasket 200 may be fabricated from a metallic plate, metallic strips, or a metallic mold or die. In such embodiments, the conductive gasket 200 may include compressible elements such as spring fingers to ensure contact between the conductive gasket 200 and the shield body 118 and/or the ground plane 168.

Figure 5:
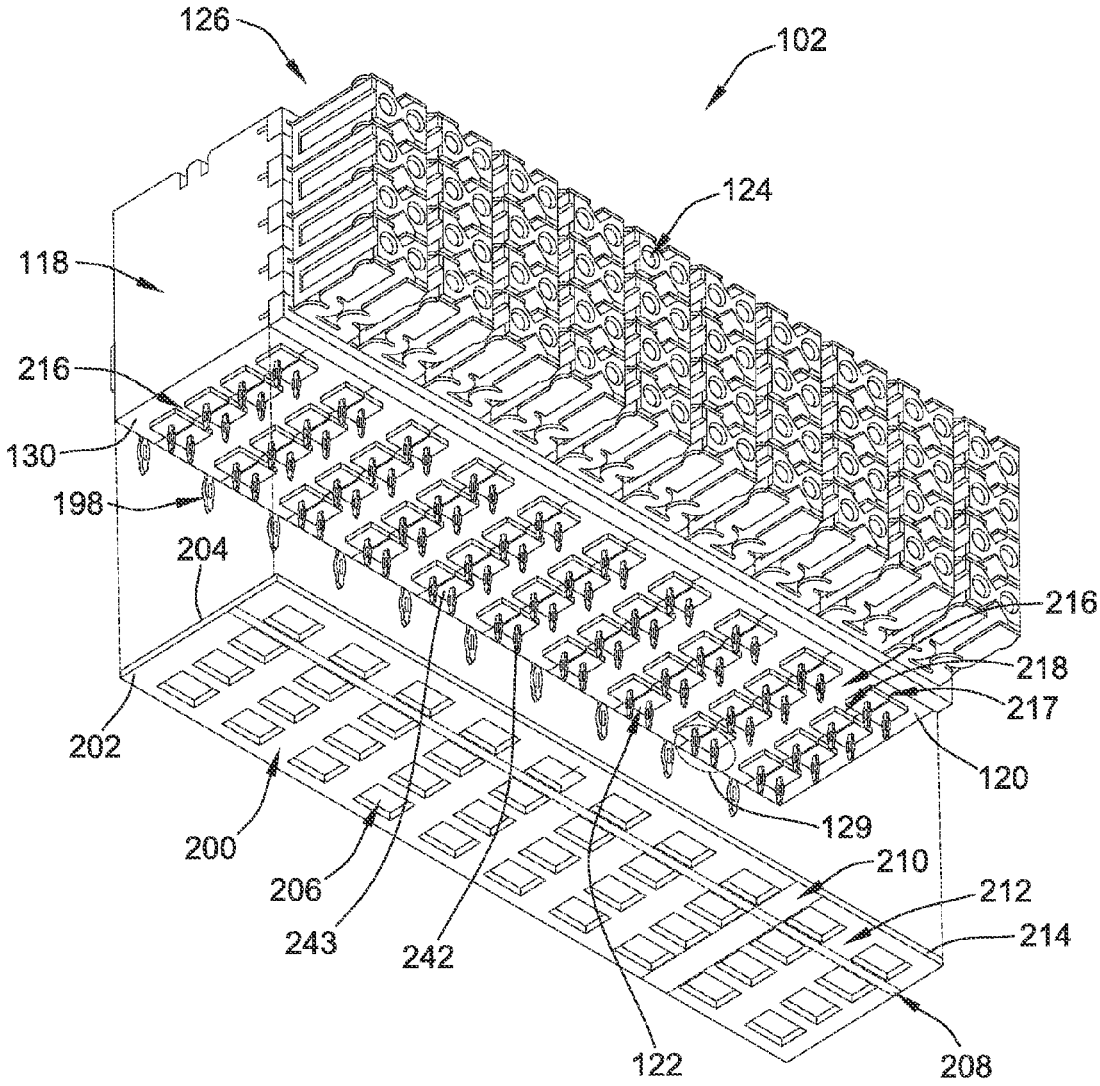
FIG. 5 is a bottom perspective view of the receptacle assembly.

FIG. 5 is a bottom perspective view of the receptacle assembly 102 in an assembled state with the conductive gasket 200 poised for mounting to the receptacle assembly 102. When assembled, the mating housing 126 is coupled to a front of the shield body 118.

The conductive gasket 200 includes a plurality of openings 206. The openings 206 are configured to receive portions of the contact modules 122 therethrough. For example, contact tails 242 of the receptacle contacts 124 and leg portions 243 of the contact modules 122 are configured to extend into respective openings 206 in the conductive gasket 200. The leg portions 243 may define a stop surface for the conductive gasket 200 when mounting the receptacle assembly 102 to the circuit board 106. For example, the conductive gasket 200 may be compressed until the leg portions 243 bottom out on the circuit board 106. The contact tails 242 are configured to be received in the signal vias 168 (shown in FIG. 2) when the receptacle assembly 102 is mounted to the circuit board 106. The leg portions 243 are dielectric and electrically isolate the contact tails 242 from the conductive gasket 200. In an exemplary embodiment, each opening 206 is configured to receive two contact tails 242 that together define one of the differential pairs 129. As such, the conductive gasket 200 entirely surrounds each differential pair 129 at the interface with the circuit board 106. The conductive gasket 200 is provided between each adjacent differential pair 129. The openings 206 may have any size and shape depending on the particular embodiment. In the illustrated embodiment, the openings 206 are rectangular. The openings 206 may be square, circular, oval, irregular shaped, and the like in alternative embodiments.

The conductive gasket 200 includes a plurality of longitudinal strips 208 and a plurality of lateral strips 210 that intersect with the longitudinal strips 208 to form a lattice 212. In an exemplary embodiment, the longitudinal strips 208 and lateral strips 210 are integrally formed with one another. The longitudinal strips 208 and lateral strips 210 cooperate to define the openings 206. For example, each opening 206 is bounded by two longitudinal strips 208 and two lateral strips 210. The layout and footprint of the lattice 212 is sized and shaped similar to the size and shape of the lattice 178 (shown in FIG. 2) of the ground plane 166 (shown in FIG. 2). As such, when the conductive gasket 200 is mounted to the ground plane 166, the longitudinal strips 208 and lateral strips 210 are aligned with, and engage, the longitudinal strips 174 and lateral strips 176 (both shown in FIG. 2) to make electrical contact with the ground plane 166. The openings 206 are sized relative to the lattice 178 such that the lattice 178 comprises a majority of the footprint, and the openings 206 comprise a minority of the footprint. As such, then the conductive gasket 200 is mounted to the circuit board 106, a majority of the footprint engages the ground plane 166.

The conductive gasket 200 includes an outer perimeter 214. The outermost longitudinal strips 208 and the outermost lateral strips 210 define the outer perimeter 214. In the illustrated embodiment, the outer perimeter 214 has a rectangular shape, however other shapes are possible in alternative embodiments. Each of the openings 206 is contained within the outer perimeter 214.

The shield body 118 includes web portions 216 at the mounting end 130. The web portions 216 are defined by the bottom of the holders 120. The web portions 216 are provided between portions of the contact modules 122 and the conductive gasket 200. The web portions 216 extend between the leg portions 243 of the contact modules 122. The leg portions 243 extend through the bottom of the holders 120 and are surrounded by the web portions 216. The leg portions 243 each surround a corresponding contact tail 242, and thus the contact tails 242 are surrounded by the web portions 216. The web portions 216 provide electrical shielding around the contact tails 242. In the illustrated embodiment, the leg portions 243 of two adjacent contact modules 122 are arranged in a set and abut against each other. The sets of leg portions 243 extend through the holders 120 and extend beyond the mounting end 130. The sets of leg portions 243 are surrounded by the web portions 216. The web portions 216 provide electrical shielding around the sets of leg portions 243.

In the illustrated embodiment, the bottoms of the holders 120 include openings 217 at the sides of the holders 120, with fingers 218 positioned between the openings 217. The openings 217 receive the leg portions 243. The fingers 218, along with the bottom of the holders 120, define the web portions 216. The holders 120 are positioned adjacent one another such that the openings 217 are aligned with openings 217 of the adjacent holder 120. The holders 120 are positioned adjacent one another such that the fingers 218 are aligned with fingers 218 of the adjacent holder 120. The fingers 218 of adjacent holders 120 may abut against one another.

When the conductive gasket 200 is mounted to the mounting end 130, the leg portions 243 and contact tails 242 extend into the openings 206. The longitudinal strips 208 and lateral strips 210 cooperate to surround each of the differential pairs 129. The conductive gasket 200 provides electrical shielding at the interface with the circuit board 106. The conductive gasket 200 is positioned along the mounting end 130 such that the second mounting surface 204 engages and extends along the web portions 216. The longitudinal strips 208 and lateral strips 210 have a complementary size, shape and layout as the web portions 216 such that the longitudinal strips 208 and lateral strips 210 engage the web portions 216. Additionally, the longitudinal strips 208 and lateral strips 210 have a complementary size, shape and layout as the longitudinal strips 174 (shown in FIG. 2) and the lateral strips 176 (shown in FIG. 2), respectively, of the ground plane 166 (shown in FIG. 2). As such, the conductive gasket 200 is interposed between the ground plane 166 and the web portions 216 of the shield body 118. When the shield body 118 is coupled to the circuit board 106, the conductive gasket 200 creates a ground path between the ground plane 166 and the shield body 118. The conductive gasket 200 may be at least partially compressed when the shield body 118 is coupled to the circuit board 106 to ensure electrical connection with the entire footprint of the shield body 118 and the ground plane 166. The receptacle assembly 102 maintains the compression of the conductive gasket 200 when the receptacle assembly 102 is mounted to the circuit board 106. For example, the contact tails 242 may hold the receptacle assembly 102 onto the circuit board 106 by an interference fit with the corresponding vias in the circuit board 106. In an alternative embodiment, board locks, such as fasteners or solder tabs, may be provided to secure the receptacle assembly 102 to the circuit board 106.

Figure 6:
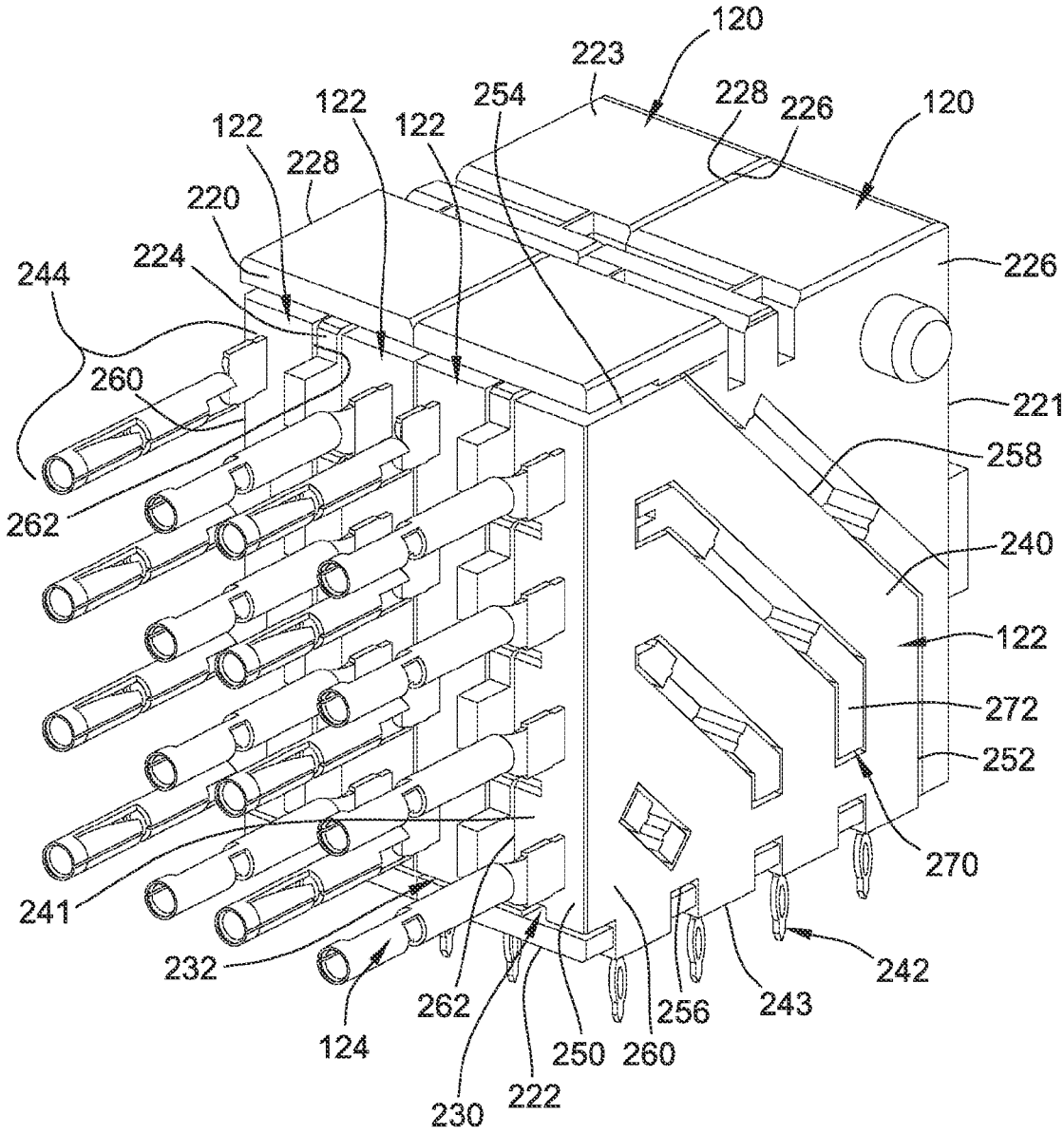
FIG. 6 is a front perspective view of a portion of the receptacle assembly showing a plurality of contact modules and plurality of holders.

FIG. 6 is a front perspective view of a portion of the receptacle assembly 102 showing a plurality of contact modules 122 and a plurality of holders 120. The holders 120 include a front 220, a rear 221 opposite the front 220, a bottom 222 and a top 223 opposite the bottom 222. The holder 120 includes a body configured to support a plurality of the contact modules 122. The body defines a portion of the shield body 118 (shown in FIG. 1). In the illustrated embodiment, each holder 120 supports two contact modules 122. More or less contact modules 122 may be supported by a particular holder 120 in alternative embodiments.

In an exemplary embodiment, the holder 120 is fabricated from a conductive material. For example, the holder 120 may be die-cast from a metal material. Alternatively, the holder 120 may be stamped and formed or may be fabricated from a plastic material that has been metalized or coated with a metallic layer. By having the holder 120 fabricated from a conductive material, the holder 120 may define a ground shield for the receptacle assembly 102. A separate ground shield does not need to be provided and coupled to the contact modules 122 prior to assembling together the contact modules 122. Rather, the holders 120 define the ground shield and also support the contact modules 122 as part of the shield body 118.

When the holders 120 are ganged together, the holders 120 define the shield body 118 of the receptacle assembly 102. The holders 120 may be ganged together by coupling the individual holders 120 to one another or by using a separate component, such as the retainer 192 (shown in FIG. 4). The holders 120 are ganged together such that the contact modules 122 are stacked parallel to one another. When the holders 120 are ganged together, the contact modules 122 are arranged in contact module sets, with a pair of contact modules 122 in each contact module set. The contact modules 122 within each contact module set are held by two separate holders 120. When the holders 120 are coupled together, support walls 224 of the holders 120 are positioned between each contact module set to provide electrical shielding therebetween. The contact modules 122 held by each holder 120 are parts of different contact module sets.

The holders 120 provide electrical shielding between and around respective contact modules 122. The holders 120 provide shielding from electromagnetic interference (EMI) and/or radio frequency interference (RFI). The holders 120 may provide shielding from other types interference as well. The holders 120 provide shielding around the contact modules 122 to control electrical characteristics, such as impedance control, cross-talk control, and the like, of the receptacle contacts 124 within the contact modules 122. For example, by having the holders 120 electrically grounded, the holders 120 provide shielding for the contact modules 122 to control the electrical characteristics. In the illustrated embodiment, the holders 120 provide shielding along the top, back, and bottom of the contact modules 122. Optionally, the holders 120 may provide shielding between any or all of the contact modules 122. For example, as in the illustrated embodiment, each holder 120 includes a support wall 224. The support wall 224 is provided between the pair of contact modules 122 held by the holder 120. The support wall 224 provides shielding between the contact modules 122 held by the holder 120. Optionally, the support wall 224 may be substantially centrally located between opposite sides 226. 228 of the holder 120.

The holder 120 includes a first receptacle chamber 230 at the first side 226 and a second receptacle chamber 232 at the second side 228. Each receptacle chamber 230, 232 receives one of the contact modules 122 therein. The contact modules 122 are loaded into the corresponding receptacle chambers 230, 232 such that the contact modules 122 abut against the support wall 224. Alternatively, the receptacle chambers 230 and/or 232 may receive more than one contact module 122. In other alternative embodiments, only one receptacle chamber is provided in each holder 120, with the receptacle chamber receiving one, two or more contact modules 122 therein.

Each contact module 122 includes a dielectric body 240 surrounding the receptacle contacts 124. The dielectric body 240 includes a mating end 241 and a mounting end 243. In an exemplary embodiment, the receptacle contacts 124 are initially held together as a lead frame, which is overmolded with a dielectric material to form the dielectric body 240. After the lead frame is overmolded, the receptacle contacts 124 are separated from one another. Other manufacturing processes may be utilized to form the contact modules 122 other than overmolding a lead frame, such as loading receptacle contacts 124 into a formed dielectric body.

Each of the receptacle contacts 124 includes one of the contact tails 242 at one end thereof, and a mating portion 244 at an opposite end thereof. The mating portions 244 and contact tails 242 are the portions of the receptacle contacts 124 that extend from the dielectric body 240. The mating portions 244 extend from the mating end 241 and the contact tails 242 extend from the mounting end 243. In an exemplary embodiment, the mating portions 244 extend generally perpendicular with respect to the contact tails 242. The receptacle contacts 124 transition between the mating portions 244 and the contact tails 242 within the dielectric body 240. Alternatively, the mating portions 244 may be non-perpendicular with respect to the contact tails 242. For example, the mating portions 244 may be parallel to the contact tails 242. Optionally, the mating portions 244 may be axially aligned with the contact tails 242.

The dielectric body 240 includes a front wall 250, a rear wall 252 generally opposite the front wall 250, a top wall 254 and a bottom wall 256 generally opposite the top wall 254. Optionally, the dielectric body 240 may include a slant wall 258 extending between the top wall 254 and the rear wall 252. The slant wall 258 is angled with respect to the top wall 254 and the rear wall 252. In an exemplary embodiment, the front and rear walls 250, 252 are parallel to one another and the top and bottom walls 254, 256 are parallel to one another and generally perpendicular with the respect to the front and rear walls 250, 252. The mating portions 244 of the receptacle contacts 124 extend from the front wall 250 of the dielectric body 240. The contact tails 242 of the receptacle contacts 124 extend from the bottom wall 256 of the dielectric body 240. Other configurations are possible in alternative embodiments.

The dielectric body 240 includes a first side 260 and a second side 262 generally opposite the first side 260. The first and second sides 260, 262 are generally parallel to the sides 226, 228 of the holder 120. The first side 260 represents an outer side of the dielectric body 240 that is exposed exterior of the holder 120. The second side 262 represents an inner side of the dielectric body 240 that is loaded into the corresponding receptacle chamber 230 against the support wall 224. The contact module 122 received in the receptacle chamber 232 includes a similar dielectric body having inner and outer sides.

The dielectric body 240 includes a plurality of windows 270 extending through the dielectric body 240 between the first and second sides 260, 262. The windows 270 are open between the first and second sides 260, 262 and are spaced apart from an outer perimeter of the dielectric body 240, which is defined by the front wall 250, rear wall 252, top wall 254, bottom wall 256 and slant wall 258. The windows 270 are internal to the dielectric body 240 and located between adjacent receptacle contacts 124. For example, one or more windows 270 may be positioned between adjacent receptacle contacts 124. The windows 270 extend along lengths of the receptacle contacts 124 between the contact tails 242 and the mating portions 244. Optionally, the windows 270 may extend along a majority of the length of each receptacle contact 124 measured between the corresponding contact tail 242 and mating portion 244. The windows 270 are elongated and generally follow the paths of the receptacle contacts 124 between the contact tails 242 and the mating portions 244. The windows 270 are formed during the overmolding process that forms the dielectric body 240. For example, the dielectric body 240 is formed around molding elements that have a predetermined size and shape. The molding elements define the size, shape and position of the windows 270. In an exemplary embodiment, as described in further detail below, the holders 120 include tabs 272 that extend into the windows 270 when the contact modules 122 are coupled to the holders 120. The tabs 272 support the contact modules 122 within the corresponding receptacle chambers 230, 232. The tabs 272 provide shielding between the adjacent receptacle contacts 124.

FIG. 7 is a front perspective view of a portion of the header assembly 104 showing a plurality of contact modules 142 poised for assembly with a corresponding holder 140. The holder 140 includes a body configured to support the contact modules 142. In the illustrated embodiment, each holder 140 supports two contact modules 142. More or less contact modules 142 may be supported by the holder 140 in alternative embodiments. In an exemplary embodiment, the holder 140 is fabricated from a conductive material. The holder 140 provides electrical shielding between and around the contact modules 142, such as from EMI. RFI, or other types of interference. When the holders 140 are ganged together, the holders 140 define the shield body 138, (shown in FIG. 1) of the header assembly 104.

The holder 140 includes a support wall 424. The support wall 424 is provided between the pair of contact modules 142. The support wall 424 provides shielding between the contact modules 142.

Each contact module 142 includes a dielectric body 440 surrounding the header contacts 144. The header contacts 144 may be formed to have a mating interface that is complementary to the receptacle contacts 124 (shown in FIG. 1) for mating with the receptacle contacts 124. Each of the header contacts 144 includes a mating portion 444 at one end thereof and a contact tail 446 at an opposite end thereof. The mating portions 444 constitute pin contacts having a generally cylindrical shape that is configured to be received within the barrel portions of the receptacle contacts 124. The contact tails 446 constitute press-fit pins, such as eye-of-the-needle contacts that are configured to be received in plated vias in the circuit board 108 (shown in FIG. 1). The dielectric body 440 includes a plurality of windows 470 extending through the dielectric body 440

The holder 140 includes tabs 472 that extend from both sides of the support wall 424. The tabs 472 extend into the windows 470 when the contact modules 142 are coupled to the holder 140. The tabs 472 form part of the shield body 138 and provide electrical shielding between adjacent header contacts 144. The tabs 472 are integrally formed with the support, wall 424 and the other portions of the holder 140.

Figure 8:
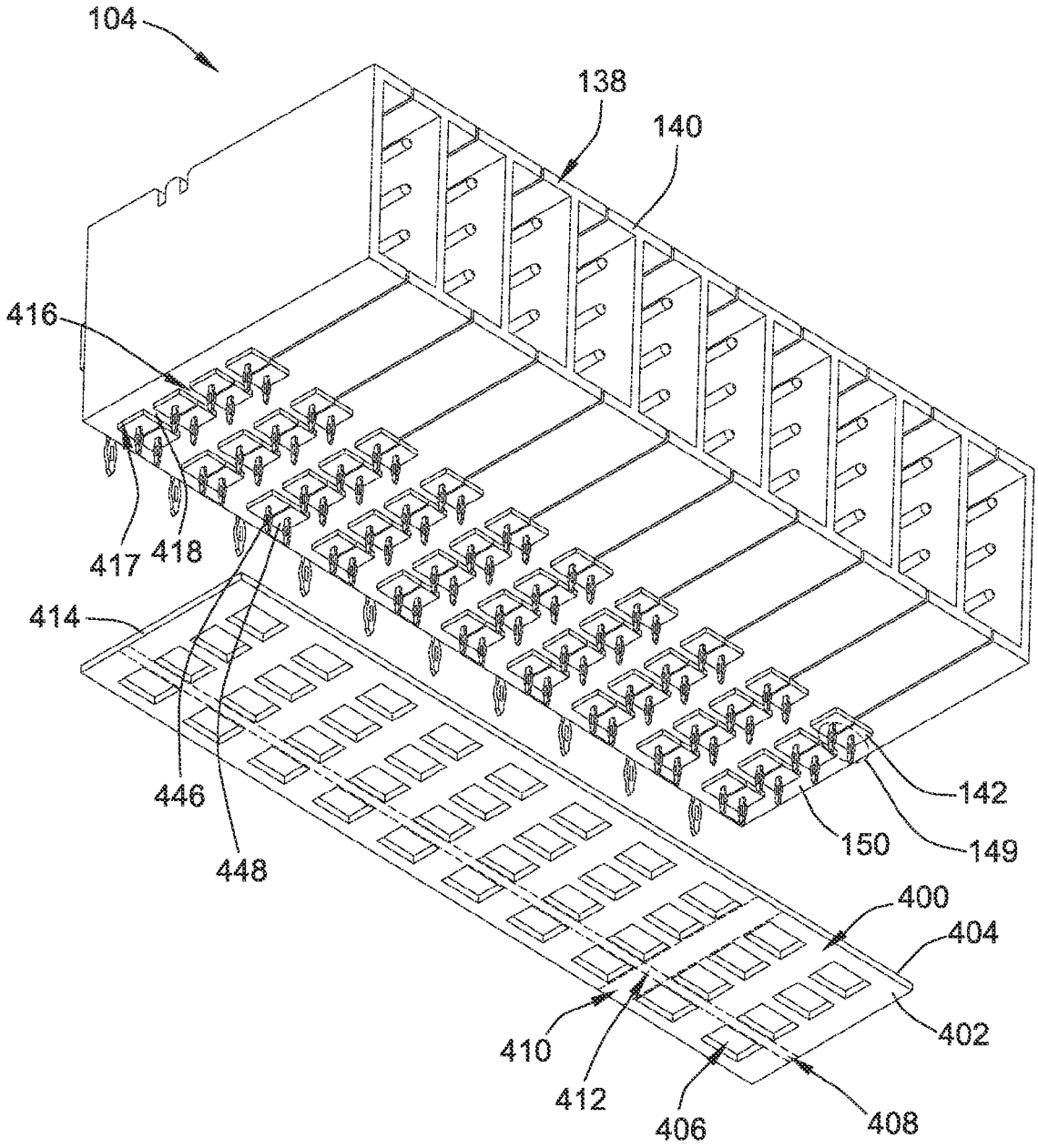
FIG. 8 is a bottom perspective view of the header assembly illustrating a conductive gasket.

FIG. 8 is a bottom perspective view of the header assembly 104 illustrating the conductive gasket 400 poised for attachment to the mounting end 150 of the header assembly 104. The conductive gasket 400 is substantially similar to the conductive gasket 200. Optionally, the conductive gaskets 200, 400 may be identical such that the conductive gaskets are interchangeable, which may reduce the total part numbers required to assemble the connector system 100 (shown in FIG. 1).

The conductive gasket 400 defines a ground path between the shield body 138 of the header assembly 104 and the circuit board 108 (shown in FIG. 3). For example, the conductive gasket 400 may engage, and be electrically connected to the holders 140 to electrically common the holders 140 to a ground circuit on the circuit board 108.

The conductive gasket 400 includes a first mounting surface 402 that is configured to be mounted to and engage, the ground plane 366 (shown in FIG. 3) of the circuit board 108. The conductive gasket 400 includes a second mounting surface 404 opposite the first mounting surface 402 that engages the shield body 138. The conductive gasket 400 defines a ground path between the ground plane 366 of the circuit board 108 and the shield body 138 of the header assembly 104. As such, the shield body 138 is electrically grounded through the conductive gasket 400. The conductive gasket 400 allows the header assembly 104 to be electrically grounded to the circuit board 108 without using individual ground contacts or ground pins. Rather, the header assembly 104 includes a planar mounting surface at the mounting end 150 that is configured to be electrically grounded to electrically ground the header assembly 104.

The conductive gasket 400 includes a plurality of openings 406. The openings 406 are configured to receive portions of the contact modules 142 therethrough. For example, contact tails 446 and leg portions 448 of the contact modules 142 are configured to extend into respective openings 406 in the conductive gasket 400. The contact tails 446 are configured to be received in the signal vias 368 (shown in FIG. 3) when the header assembly 104 is mounted to the circuit board 108. The leg portions 448 are dielectric and electrically isolate the contact tails 446 from the conductive gasket 400. In an exemplary embodiment, each opening 406 is configured to receive two contact tails 446 that together define one of the differential pairs 149. As such, the conductive gasket 400 entirely surrounds each differential pair 149 at the interface with the circuit board 108. The conductive gasket 400 is provided between each adjacent differential pair 149.

The conductive gasket 400 includes a plurality of longitudinal strips 408 and a plurality of lateral strips 410 that intersect with the longitudinal strips 408 to form a lattice 412. In an exemplary embodiment, the longitudinal strips 408 and lateral strips 410 are integrally formed with one another. The longitudinal strips 408 and lateral strips 410 cooperate to define the openings 406. The outermost longitudinal strips 408 and the outermost lateral strips 410 together define an outer perimeter 414 of the conductive gasket 400.

The shield body 138 includes web portions 416 at the mounting end 150. The web portions 416 are defined by the bottom of the holders 140. The web portions 416 extend between the leg portions 448 of the contact modules 142. The leg portions 448 extend through the bottom of the holders 140 and are surrounded by the web portions 416. The leg portions 448 each surround a corresponding contact tail 446, and thus the contact tails 446 are surrounded by the web portions 416. The web portions 416 provide electrical shielding around the contact tails 446.

In the illustrated embodiment, the bottoms of the holders 140 include openings 417 at the sides of the holders 140, with fingers 418 positioned between the openings 417. The openings 417 receive the leg portions 448. The fingers 418, along with the bottom of the holders 140, define the web portions 416. The holders 140 are positioned adjacent one another such that the openings 417 are aligned with openings 417 of the adjacent holder 140. The holders 140 are positioned adjacent one another such that the fingers 418 are aligned with fingers 418 of the adjacent holder 140. The fingers 418 of adjacent holders 140 may abut against one another.

When assembled, the conductive gasket 400 is positioned along the mounting end 150 such that the second mounting surface 404 engages and extends along the web portions 416. The conductive gasket 400 provides electrical shielding at the interface with the circuit board 108. The longitudinal strips 408 and lateral strips 410 have a complementary size, shape and layout as the web portions 416 such that the longitudinal strips 408 and lateral strips 410 engage the web portions 416. Additionally, the longitudinal strips 408 and lateral strips 410 have a complementary size, shape and layout as the longitudinal strips 374 (shown in FIG. 3) and the lateral strips 376 (shown in FIG. 3), respectively, of the ground plane 366 (shown in FIG. 3). As such, the conductive gasket 400 is interposed between the ground plane 366 and the web portions 416 of the shield body 138. When the shield body 138 is coupled to the circuit board 108, the conductive gasket 400 creates a ground path between the ground plane 366 and the shield body 138. The conductive gasket 400 may be at least partially compressed when the shield body 138 is coupled to the circuit board 108 to ensure electrical connection with the entire footprint of the shield body 138 and the ground plane 366.

Figure 9:
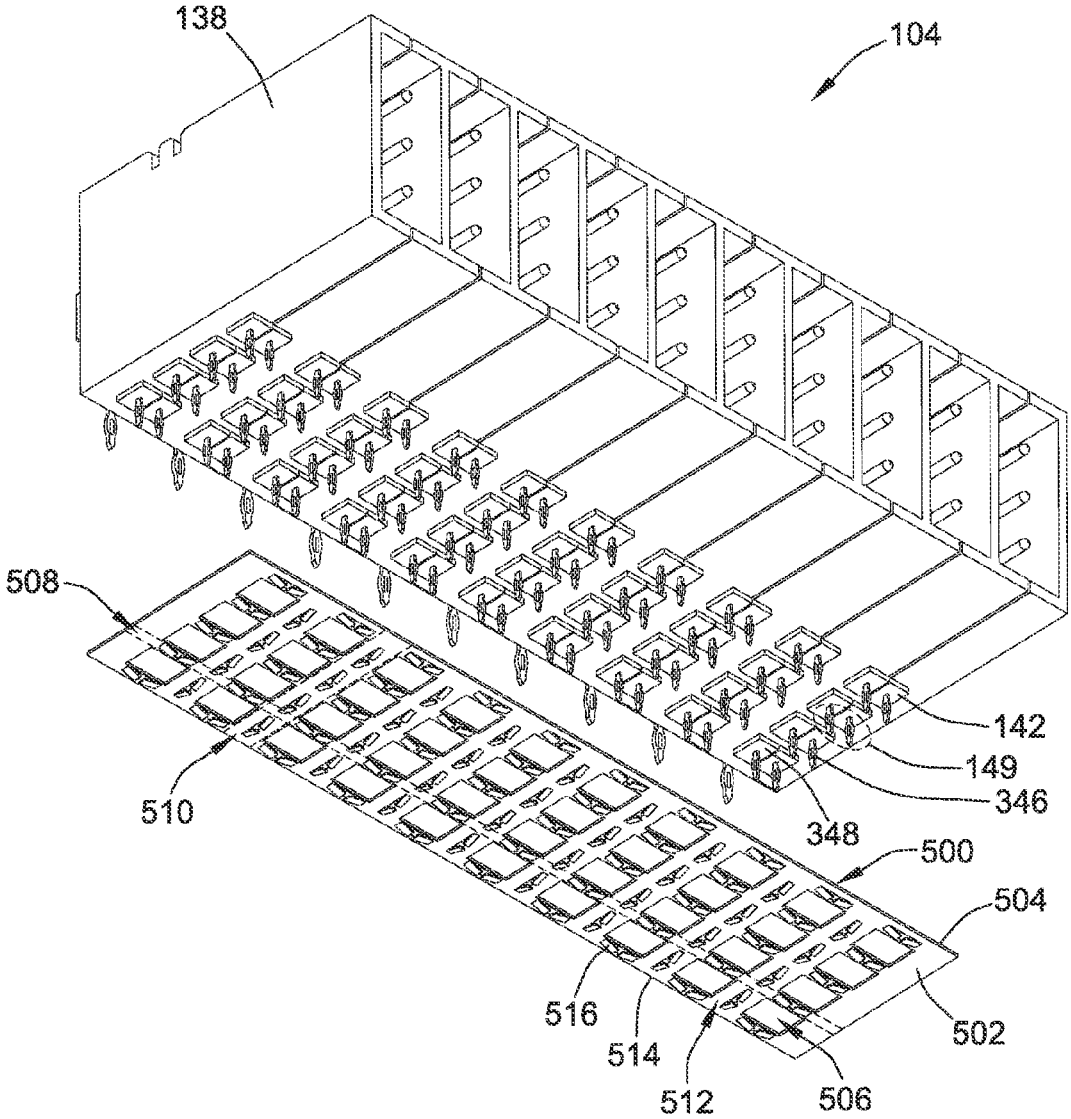
FIG. 9 is a bottom perspective view of the header assembly with an alternative conductive gasket poised for mounting to the header assembly.

FIG. 9 is a bottom perspective view of the header assembly 104 with an alternative conductive gasket 500 poised to be mounted to the header assembly 104. The conductive gasket 500 may similarly be used with the receptacle assembly 102 (shown in FIG. 1).

The conductive gasket 500 is stamped and formed from a metal plate. The conductive gasket 500 includes a first mounting surface 502 that is configured to be mounted to and engage, the ground plane 366 (shown in FIG. 3) of the circuit hoard 108. The conductive gasket 500 includes a second mounting surface 504 opposite the first mounting surface 502 that engages the shield body 138. The conductive gasket 500 defines a ground path between the ground plane 366 of the circuit board 108 and the shield body 138 of the header assembly 104. As such, the shield body 138 is electrically grounded through the conductive gasket 500.

The conductive gasket 500 includes a plurality of openings 506. The openings 506 are configured to receive portions of the contact modules 142 therethrough. For example, contact tails 346 and leg portions 348 of the contact modules 142 are configured to extend into respective openings 506 in the conductive gasket 500. The leg portions 348 are dielectric and electrically isolate the contact tails 346 from the conductive gasket 500. In an exemplary embodiment, each opening 506 is configured to receive two contact tails 346 that together define one of the differential pairs 149. As such, the conductive gasket 500 entirely surrounds each differential pair 149 at the interface with the circuit board 108. The conductive gasket 500 is provided between each adjacent differential pair 149.

The conductive gasket 500 includes a plurality of longitudinal strips 508 and a plurality of lateral strips 510 that intersect with the longitudinal strips 508 to form a lattice 512. In an exemplary embodiment, the longitudinal strips 508 and lateral strips 510 are integrally formed with one another. The longitudinal strips 508 and lateral strips 510 cooperate to define the openings 506. The outermost longitudinal strips 508 and the outermost lateral strips 510 together define an outer perimeter 514 of the conductive gasket 500.

The conductive gasket 500 includes a plurality of spring fingers 516 that are bent out of plane with respect to the conductive gasket 500. The spring fingers 516 are provided in both the longitudinal strips 508 and lateral strips 510. The spring fingers 516 are configured to engage the header assembly 104 and/or the circuit board 108 (shown in FIG. 1). Optionally, the spring fingers 516 may extend below the leg portions 348 such that the spring fingers 516 may be compressed and deflected when the header assembly 104 is mounted to the circuit board 108, such as until the leg portions 348 engage the circuit board 108. In the illustrated embodiment, the spring fingers 516 are bent downward out of the plane of the conductive gasket 500 to engage the ground plane 366. Alternatively, at least some of the spring fingers 516 may be bent upward and some of the spring fingers 516 may be bent downward to engage both the header assembly 104 and the ground plane 366. Any number of spring fingers 516 may be provided. Having multiple spring fingers 516 creates multiple points of contact to the header assembly 104 and/or the circuit board 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

contacts having contact tails and mating portions opposite the contact tails, the contact tails being configured to be terminated to a circuit board, the mating portions being configured to be terminated to corresponding mating contacts of a mating connector assembly;

a shield body holding the contacts, the shield body having a mounting end configured to be mounted to the circuit board, the mounting end having web portions extending between selected contacts; and a conductive gasket positioned along the mounting end of the shield body, the conductive gasket engaging the web portions of the shield body and being configured to define a ground path between the shield body and a ground plane of the circuit board.

2. The connector assembly of claim 1, wherein the conductive gasket includes longitudinal strips and lateral strips arranged in a lattice having openings, the contact tails extending through the openings, the contact tails being spaced apart from the longitudinal strips and lateral strips.

3. The connector assembly of claim 1, wherein the conductive gasket is planar having a first mounting surface configured to engage the ground plane, and a second mounting surface engaging the web portions.

4. The connector assembly of claim 1, wherein the conductive gasket is a conductive elastomeric sheet having openings, the openings receiving the contact tails.

5. The connector assembly of claim 1, wherein the conductive gasket is metal plate having a plurality of openings, the openings receiving the contact tails, the metal plate having spring fingers extending therefrom configured to engage at least one of the web portion or the ground plane.

6. The connector assembly of claim 1, wherein the contacts are arranged in differential pairs, the conductive gasket being positioned between each adjacent differential pair of contact tails.

7. The connector assembly of claim 1, further comprising contact modules loaded into the shield body, each contact module having a dielectric body holding a plurality of the contacts, the contact modules having leg portions with the contact tails extending from corresponding leg portions, the conductive gasket being positioned between selected leg portions.

8. The connector assembly of claim 1, wherein the conductive gasket is compressive, the conductive gasket being configured to be compressed between the mounting end of the shield body and the circuit board.

9. A connector assembly comprising:

contact modules each having a dielectric body, the dielectric body having a mating end and a mounting end, the contact modules having contacts held by the dielectric body with contact tails extending from the mounting end of the dielectric body;

a shield body holding the contact modules in a stacked configuration, the shield body having a mounting end configured to be mounted to a circuit board, the shield body extending between selected contact modules; and a conductive gasket positioned along the mounting end of the shield body, the conductive gasket engaging the shield body and being configured to define a ground path between the shield body and a ground plane of the circuit board.

10. The connector assembly of claim 9, wherein the contact modules are arranged in contact module sets with two contact modules in the contact module sets, the shield body extending between, and providing electrical shielding between, adjacent contact module sets.

11. The connector assembly of claim 9, wherein the shield body is positioned between, and provides electrical shielding between, portions of the dielectric body and the conductive gasket.

12. The connector assembly of claim 9, wherein the conductive gasket includes longitudinal strips and lateral strips arranged in a lattice having openings, the contact tails extending through the openings, the contact tails being spaced apart from the longitudinal strips and lateral strips.

13. The connector assembly of claim 9, wherein the contacts are arranged in differential pairs, the conductive gasket being positioned between each adjacent differential pair of contact tails.

14. The connector assembly of claim 9, wherein the conductive gasket is a conductive elastomeric sheet having openings, the openings receiving the contact tails.

15. The connector assembly of claim 9, wherein the conductive gasket is metal plate having a plurality of openings, the openings receiving the contact tails, the metal plate having spring fingers extending therefrom configured to engage at least one of the web portion or the ground plane.

16. A connector system comprising:

a circuit board having a mounting surface, the circuit board having a plurality of signal vias and a plurality of ground vias, the circuit board having a ground plane along the mounting surface, the ground plane interconnecting the plurality of ground vias; and a connector assembly comprising:

contacts having contact tails and mating portions opposite the contact tails, the contact tails being received in the signal vias, the mating portions being configured to be terminated to corresponding mating contacts of a mating connector assembly;

a shield body holding the contacts, the shield body having a mounting end mounted to the circuit board, the mounting end having web portions extending between selected contacts; and a conductive gasket positioned along the mounting end of the shield body, the conductive gasket engaging the web portions of the shield body, and the conductive gasket engaging the ground plane to define a ground path between the shield body and the ground plane of the circuit board.

17. The connector assembly of claim 16, wherein the ground plane includes longitudinal strips and lateral strips arranged in a lattice having openings, the signal vias being provided within the openings, the ground vias being provided in the longitudinal strips and the lateral strips.

18. The connector assembly of claim 16, wherein the conductive gasket has a footprint, a majority of the footprint contacting the ground plane.

19. The connector assembly of claim 16, wherein the conductive gasket is a conductive elastomeric sheet having openings, the openings receiving the contact tails.

20. The connector assembly of claim 16, wherein the conductive gasket is metal plate having a plurality of openings, the openings receiving the contact tails, the metal plate having spring fingers extending therefrom configured to engage at least one of the web portion or the ground plane.

* * * * *